US009469018B2

(12) United States Patent
Zhang

(10) Patent No.: US 9,469,018 B2
(45) Date of Patent: Oct. 18, 2016

(54) ADJUSTABLE WRENCH

(71) Applicant: Ruqian Zhang, Hangzhou (CN)
(72) Inventor: Ruqian Zhang, Hangzhou (CN)
(73) Assignee: Toolrich Imp & Exp. Co., Ltd. (CN)

( * ) Notice: Subject to any disclaimer, the term of this patent is extended or adjusted under 35 U.S.C. 154(b) by 328 days.
(21) Appl. No.: 14/316,346
(22) Filed: Jun. 26, 2014
(65) Prior Publication Data
US 2015/0375374 A1 Dec. 31, 2015
(51) Int. Cl.
*B25B 13/14* (2006.01)
(52) U.S. Cl.
CPC ..... *B25B 13/14* (2013.01)
(58) Field of Classification Search
CPC ..... B25B 13/14
USPC ..... 81/77, 172
See application file for complete search history.

(56) References Cited

U.S. PATENT DOCUMENTS 390,422 A * 10/1888 White ..... B25B 13/12 81/166
530,518 A * 12/1894 Friede ..... B25B 13/14 123/145 R
592,199 A * 10/1897 Fletcher ..... B25B 13/14 269/243
717,390 A * 12/1902 Gray ..... B25B 13/12 81/171
2,993,398 A * 7/1961 Schlote ..... B25B 13/14 81/165
3,104,570 A * 9/1963 Haenni ..... B25B 13/46 81/126
3,204,497 A * 9/1965 Dinkler ..... B25B 13/16 81/77
3,282,136 A * 11/1966 Maichen ..... B25B 13/12 81/129
3,363,490 A * 1/1968 Maichen ..... B25B 13/12 81/128
3,541,899 A * 11/1970 Tanner ..... B25B 13/14 81/165
3,555,939 A * 1/1971 Halls ..... B25B 13/14 81/165
3,640,159 A * 2/1972 Halls ..... B25B 13/14 74/457
3,673,896 A * 7/1972 Vardaman ..... B25B 13/14 81/165
D239,759 S * 5/1976 Glantz ..... D8/22
4,046,034 A * 9/1977 Flewelling ..... B25B 13/14 81/165
4,151,763 A * 5/1979 Colvin ..... B25B 13/12 81/128
4,488,461 A * 12/1984 Hurtig ..... B25B 13/12 81/109
4,593,585 A * 6/1986 Hurtig ..... B25B 13/14 81/109
4,787,275 A * 11/1988 Colvin ..... B25B 13/16 81/155
D303,916 S * 10/1989 Colvin ..... D8/22
4,987,805 A * 1/1991 Ejdenwik ..... B25B 13/14 81/155
5,557,993 A * 9/1996 Austin ..... B25B 13/14 81/165
6,076,434 A * 6/2000 Boukis ..... B25B 13/16 81/165
6,240,814 B1 * 6/2001 Boyd ..... B25B 13/14 81/166
6,973,857 B1 * 12/2005 Anderson ..... B25B 13/18 60/591
9,242,352 B2 * 1/2016 Arbel ..... B25B 13/12 81/129

* cited by examiner

*Primary Examiner* — David B Thomas
(74) *Attorney, Agent, or Firm* — Clement Cheng

(57) ABSTRACT

An infinitely variable speed and multi-functional wrench has a wrench body. The sockets are arranged at two ends of the wrench body. An adjustment screw bolt is arranged on the wrench body. An adjustable wrench support matches with sockets and are separately arranged on two ends of the adjustment screw bolts. An adjustment threaded sleeve is arranged between the adjustment wrench support and the adjustment screw bolt. An adjustable button fixed with the adjustment screw bolt is arranged on the adjustment screw bolt. The spacing between the sockets and the adjustable wrench support can be adjustment with the adjustable button. The diameters of the wrench holes at two ends of the wrench body varies with each other.

17 Claims, 3 Drawing Sheets

ADJUSTABLE WRENCH

FIELD OF THE INVENTION

The present invention relates to a utility wrench, especially to a continuously variable and multi-functional wrench.

BACKGROUND OF THE INVENTION

Traditionally, wrenches were fixed in size, however more recently, adjustable wrenches have been designed. Adjustable bore diameter wrenches can be easier to use.

SUMMARY OF THE INVENTION

An infinitely variable speed and multi-functional wrench has a wrench body. The sockets are arranged at two ends of the wrench body. An adjustment screw bolt is arranged on the wrench body. An adjustable wrench support matches with sockets and are separately arranged on two ends of the adjustment screw bolts. An adjustment threaded sleeve is arranged between the adjustment wrench support and the adjustment screw bolt. An adjustable button fixed with the adjustment screw bolt is arranged on the adjustment screw bolt. The spacing between the sockets and the adjustable wrench support can be adjustment with the adjustable button. The diameters of the wrench holes at two ends of the wrench body varies with each other.

Preferably, an adjustment placement frame is arranged in the wrench body. The adjustment screw bolt is arranged in the adjustment placement frame. An adjustment placement slot is placed and adjusted with the adjustable button arranged on the adjustment placement frame. The adjustment placement slot is arranged in an adjustment cover. The adjustment cover is fixed with the wrench body. A screw placement slot is separately arranged on the two ends of the wrench body and the screw placement slot can be placed and adjusted with the adjustment screw sleeve through a placement rod. Preferably, a mating slot matches with the wrench hole and is arranged on the outer wall of the adjustment wrench support. The cross section of the mating slot is preferably triangular. Preferably, the wrench body is made of plastic or metal. The pore diameter of the sockets on the left and right side may vary dependant on actual conditions and also can be different dimensions.

The adjustable wrench optionally has the adjustable button retained to the wrench body by the adjustment cover. The adjustable button has a protrusion on an underside of the adjustable button that protrudes into and engages a helical groove formed on the adjustment screw bolt. A thread angle of the helical groove is preferably less than a thread angle of the adjustment threaded sleeve. A pitch of the helical groove is preferably less than a pitch of the adjustment threaded sleeve. A lead of the helical groove is preferably more than a lead of the adjustment threaded sleeve.

The following call out list of elements can be a useful guide in referencing the elements of the drawings.

1 Wrench Body
2 Sockets
3 Adjustment Screw Bolt
4 Adjustable Wrench Support
5 Adjustment Threaded Sleeve
6 Threaded Wall
7 Adjustable Button
8 Adjustment Placement Frame
9 Adjustment Placement Slot
10 Adjustment Cover
11 Screw Placement Slot
12 Placement Rod
13 Mating Slot
14 Helical Groove
15 Adjustable Button Protrusion
16 Adjustment Screw Bolt Bearings

DETAILED DESCRIPTION OF THE PREFERRED EMBODIMENT

Figure 1:
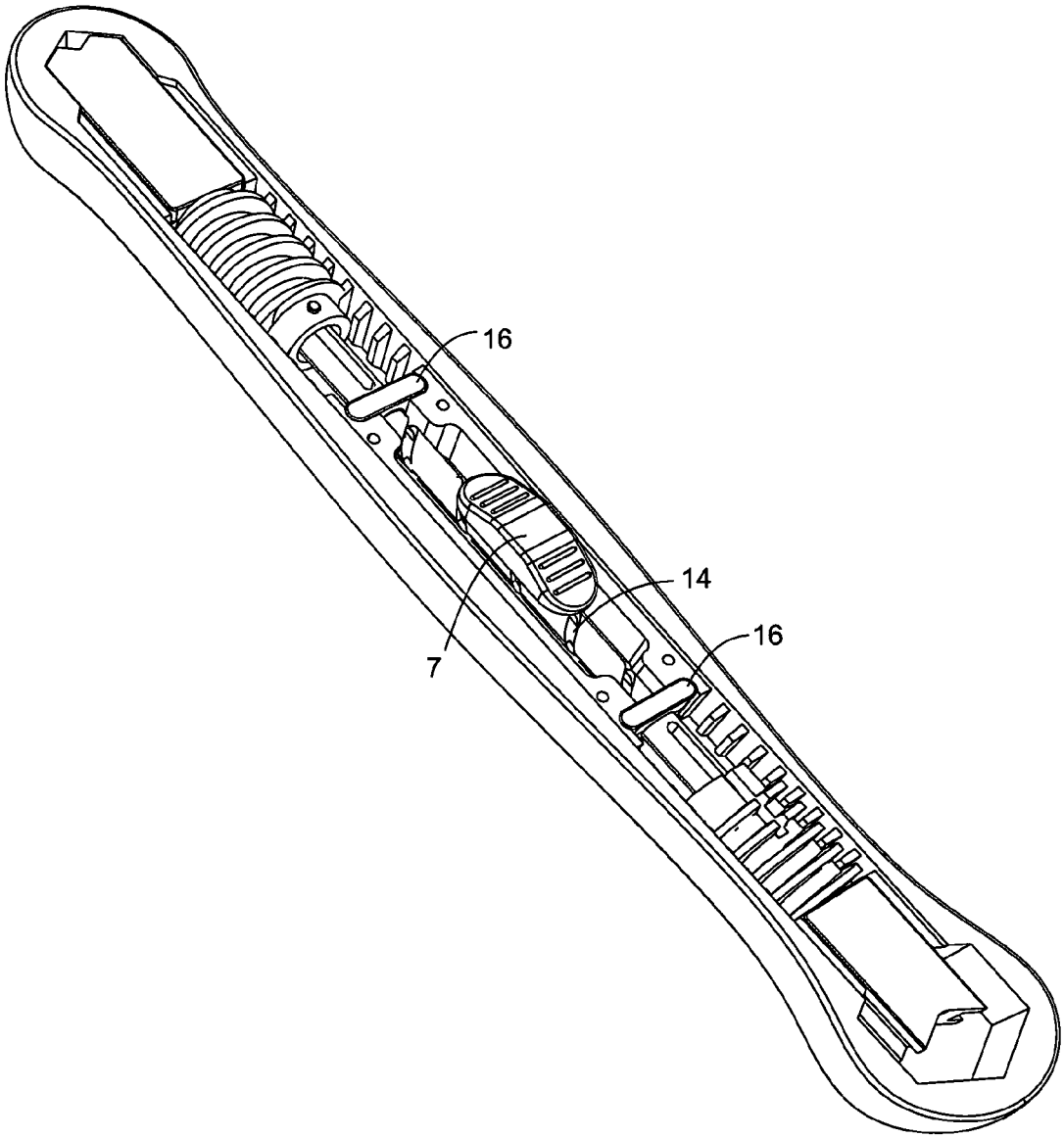
FIG. 1 is a diagram of the present invention with the adjustment cover removed so that the helical groove is exposed.
Figure 2:
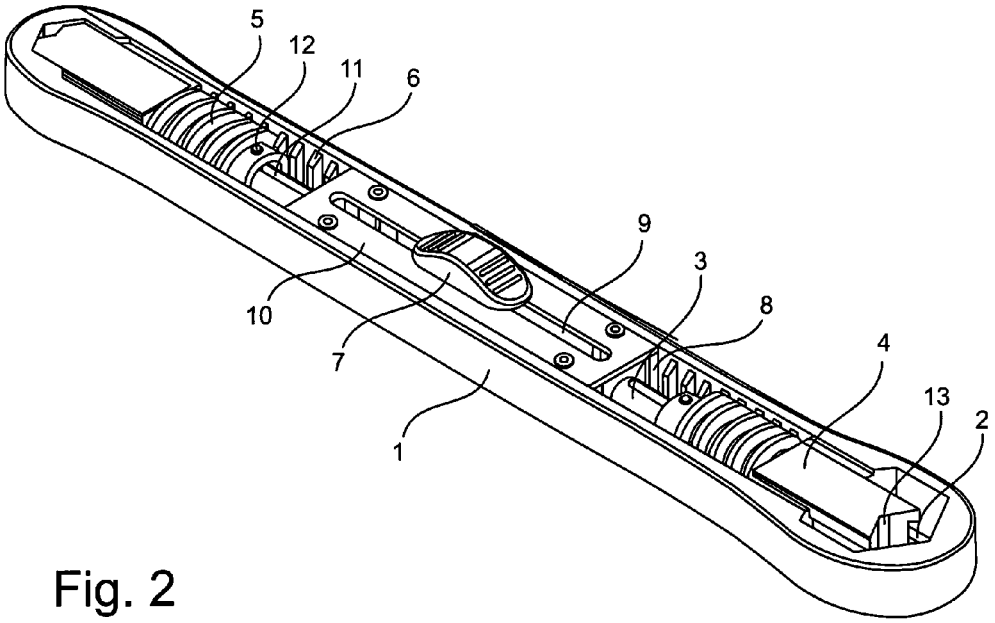
FIG. 2 is a perspective top view of the present invention.
Figure 3:
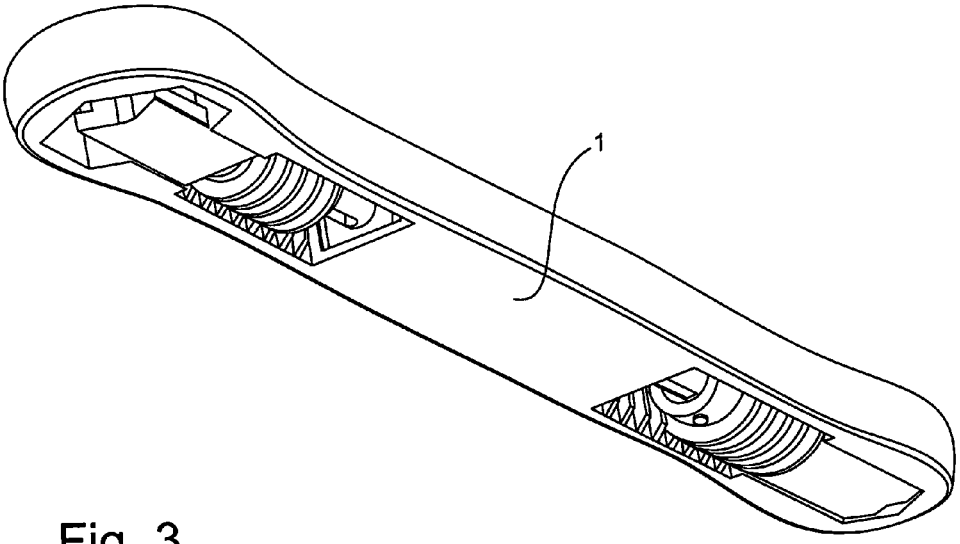
FIG. 3 is a perspective bottom view of the present invention.
Figure 4:
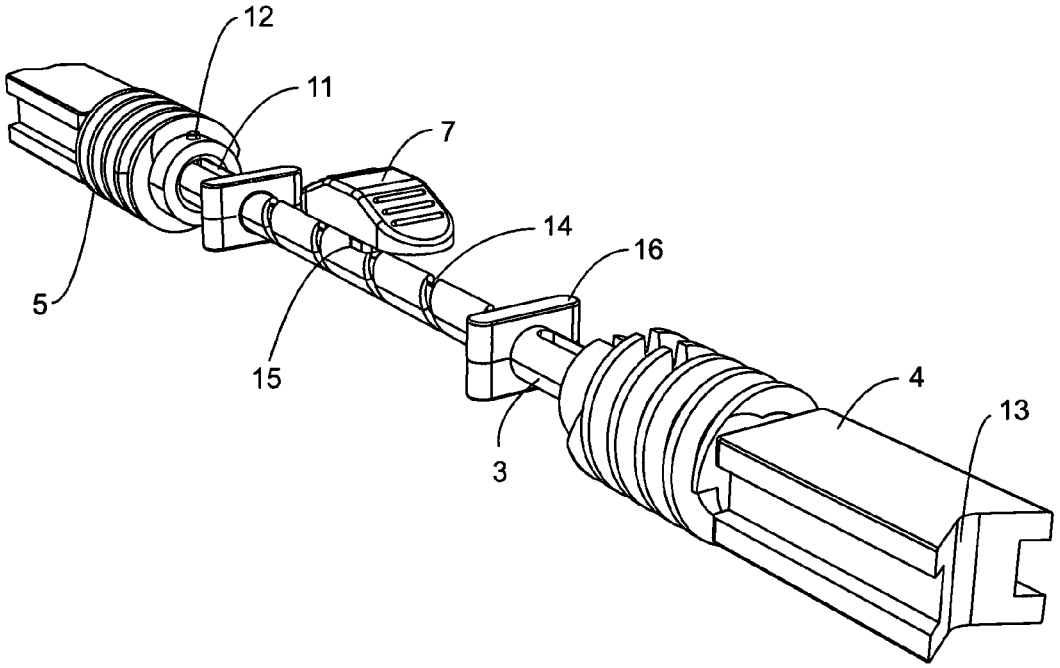
FIG. 4 is a perspective view of the moving parts of the invention with the wrench body removed to show the adjustable button protrusion engaging the helical groove of the adjustment screw bolt.

As indicated in FIGS. 1-3, an adjustable wrench has a wrench body 1. Sockets 2 are arranged at two ends of the wrench body 1. An adjustment screw bolt 3 is arranged on the wrench body 1. An adjustable wrench support 4 matches with sockets 2 separately arranged on two ends of the adjustment screw bolts 3. An adjustment threaded sleeve 5 is arranged between the adjustment wrench support 4 and the adjustment screw bolt 3. The adjustment screw sleeve 5 is screwed with the threaded wall 6 of the inner wall of the wrench body 1. An adjustable button 7 fixed with the adjustment screw bolt 3 is arranged on the adjustment screw bolt 3. The spacing between the sockets 2 and the adjustable wrench support 4 can be adjusted with the adjustable button 7 and the diameters of the socket 2 made as adjustable size openings at two ends of the wrench body 1 can vary relative to each other.

An adjustment placement frame 8 is arranged in the wrench body 1. The adjustment screw bolt 3 is arranged in the adjustment placement frame 8. An adjustment placement slot 9 to be placed and adjusted with the adjustable button 7 arranged on the adjustment placement frame 8. The adjustment placement slot 9 is arranged in an adjustment cover 10. The adjustment cover 10 is fixed with the wrench body 1. A screw placement slot 11 is separately arranged on the two ends of the wrench body 1. The screw placement slot 11 can be placed and adjusted with the adjustment screw sleeve 5 through a placement rod 12. A mating slot 13 matches with the wrench hole 2 arranged on the outer wall of the adjustment wrench support 4. The cross section of the mating slot 13 is triangular. The wrench body 1 is made of plastic or metal.

As seen in FIG. 1, the adjustable button 7 is mounted in the wrench body 1 so that adjustable button slides relative to the wrench body. The adjustable button 7 can be retained to the wrench body 1 by the adjustment cover 10. The adjustable button 7 has a protrusion that protrudes into a helical groove 14 formed on the adjustment screw bolt 3. With the adjustment cover 10 removed, the helical groove 14 is seen on a middle portion of the adjustment screw bolt 3. The adjustable button protrusion 15 travels along the helical groove 14 as the user moves the adjustable button 7 along the adjustment placement slot 9. Since the helical groove 14 is helical rather than straight, the translational motion of the adjustable button 7 actuates a rotational motion of the adjustment screw bolt 3. The turning of the adjustment screw bolt turns the adjustment placement slot 11 on both ends, and the adjustment placement slot 11 then rotates to impart rotation to the placement rod 12. When the placement rod 12 rotates, the adjustment threaded sleeve 5 is rotated so that the adjustment threaded sleeve 5 cooperates with the sidewalls of the adjustment placement frame 8 to push the adjustable wrench support 4.

The adjustable wrench support 4 is mounted in the adjustment placement frame 8 so that it translates relative to the adjustment placement frame 8. The adjustable wrench support is pivotally connected to the adjustment threaded sleeve 5 so that the adjustment threaded sleeve 5 rotates relative to the adjustable wrench support 4. The adjustable wrench support 4 does not rotate relative to the wrench body 1. The adjustment threaded sleeve 5 rotates relative to the wrench body 1. The placement rod 12 is rigidly mounted to the adjustment threaded sleeve 5. The placement rod 12 slides along the screw placement slot 11 when the adjustable button 7 is actuated. The adjustment screw bolt 3 is preferably held in a pair of adjustment screw bolt bearings 16.

More specifically, the helical groove can be formed in the adjustment screw bolt by casting, or by milling. The pitch of the helical groove is preferably less than the pitch of the adjustment threaded sleeve. The lead of the helical groove is preferably more than the lead of the adjustment threaded sleeve. Also, the thread angle of the helical groove is preferably less than the thread angle of the adjustment threaded sleeve.

The invention claimed is:

1. An adjustable wrench comprising:

a. a wrench body;

b. sockets arranged at two ends of the wrench body;

c. an adjustment screw bolt arranged on the wrench body;

d. an adjustable wrench support matching with sockets separately arranged on two ends of the adjustment screw bolt;

e. an adjustment threaded sleeve arranged between the adjustment wrench support and the adjustment screw bolt, wherein the adjustment threaded sleeve is screwed with a threaded wall of an inner wall of the wrench body; and f. an adjustable button fixed with the adjustment screw bolt arranged on the wrench body, wherein the adjustable button is between the sockets, wherein the adjustable wrench support is configure to be adjustable with the adjustable button and the diameters of the sockets at two ends of the wrench body vary from each other.

2. The adjustable wrench of claim 1, wherein an adjustment placement frame is arranged in the wrench body, wherein the adjustment screw bolt is fits at least partially within the adjustment placement frame, wherein an adjustment placement slot is placed and adjusted with the adjustable button arranged on the adjustment placement frame, wherein the adjustment placement slot is arranged in an adjustment cover, wherein the adjustment cover is fixed with the wrench body, wherein a screw placement slot is separately arranged on the two ends of the wrench body and wherein the screw placement slot is adjusted by the adjustment screw sleeve through a placement rod.

3. The adjustable wrench of claim 1, wherein a mating slot matches with the sockets arranged on the outer wall of the adjustment wrench support and, wherein the cross section of the mating slot is triangular.

4. The adjustable wrench of claim 1, wherein the wrench body is made of plastic or metal.

5. The adjustable wrench of claim 1, wherein the adjustable button is retained to the wrench body by the adjustment cover.

6. The adjustable wrench of claim 1, wherein the adjustable button has a protrusion on an underside of the adjustable button that protrudes into and engages a helical groove formed on the adjustment screw bolt.

7. The adjustable wrench of claim 6, wherein an adjustment placement frame is arranged in the wrench body, wherein the adjustment screw bolt is fits at least partially within the adjustment placement frame, wherein an adjustment placement slot is placed and adjusted with the adjustable button arranged on the adjustment placement frame, wherein the adjustment placement slot is arranged in an adjustment cover, wherein the adjustment cover is fixed with the wrench body, wherein a screw placement slot is separately arranged on the two ends of the wrench body and wherein the screw placement slot is adjusted by the adjustment screw sleeve through a placement rod.

8. The adjustable wrench of claim 6, wherein a mating slot matches with the sockets arranged on the outer wall of the adjustment wrench support and, wherein the cross section of the mating slot is triangular.

9. The adjustable wrench of claim 6, wherein the wrench body is made of plastic or metal.

10. The adjustable wrench of claim 6, wherein the adjustable button is retained to the wrench body by the adjustment cover.

11. The adjustable wrench of claim 6, wherein a thread angle of the helical groove is less than a thread angle of the adjustment threaded sleeve.

12. The adjustable wrench of claim 6, wherein a lead of the helical groove is more than a lead of the adjustment threaded sleeve.

13. The adjustable wrench of claim 12, wherein an adjustment placement frame is arranged in the wrench body, wherein the adjustment screw bolt is fits at least partially within the adjustment placement frame, wherein an adjustment placement slot is placed and adjusted with the adjustable button arranged on the adjustment placement frame, wherein the adjustment placement slot is arranged in an adjustment cover, wherein the adjustment cover is fixed with the wrench body, wherein a screw placement slot is separately arranged on the two ends of the wrench body and wherein the screw placement slot is adjusted by the adjustment screw sleeve through a placement rod.

14. The adjustable wrench of claim 12, wherein a mating slot matches with the sockets arranged on the outer wall of the adjustment wrench support and, wherein the cross section of the mating slot is triangular.

15. The adjustable wrench of claim 12, wherein the wrench body is made of plastic or metal.

16. The adjustable wrench of claim 12, wherein the adjustable button is retained to the wrench body by the adjustment cover.

17. The adjustable wrench of claim 12, wherein a thread angle of the helical groove is less than a thread angle of the adjustment threaded sleeve.

* * * * *